US010478646B2

(12) United States Patent
Sun

(10) Patent No.: US 10,478,646 B2
(45) Date of Patent: Nov. 19, 2019

(54) FALL ARREST DEVICE

(71) Applicant: YOKE INDUSTRIAL CORP., Taichung (TW)

(72) Inventor: Eason Sun, Taichung (TW)

(73) Assignee: YOKE INDUSTRIAL CORP., Taichung (TW)

( * ) Notice: Subject to any disclaimer, the term of this patent is extended or adjusted under 35 U.S.C. 154(b) by 0 days.

(21) Appl. No.: 16/195,490

(22) Filed: Nov. 19, 2018

(65) Prior Publication Data

US 2019/0083828 A1 Mar. 21, 2019

Related U.S. Application Data

(63) Continuation of application No. 15/873,451, filed on Jan. 17, 2018, now Pat. No. 10,391,339.

(30) Foreign Application Priority Data

Sep. 20, 2017 (TW) ..... 106132319 A

(51) Int. Cl.
*A62B 35/00* (2006.01)
*A62B 1/10* (2006.01)

(52) U.S. Cl.
CPC ..... *A62B 35/0093* (2013.01); *A62B 1/10* (2013.01)

(58) Field of Classification Search
CPC .... F16D 55/24; F16D 65/122; F16D 69/0408; A62B 35/0093; A62B 1/10
USPC ..... 188/65.1, 65.2, 65.4; 267/197, 198; 242/419.9; 254/375, 378, 391
See application file for complete search history.

(56) References Cited

U.S. PATENT DOCUMENTS

| | | | | |
|---|---|---|---|---|
| 8,181,744 | B2 * | 5/2012 | Parker | A62B 1/10 182/232 |
| 9,121,462 | B2 * | 9/2015 | Casebolt | A62B 1/10 |
| 9,861,841 | B1 * | 1/2018 | Hung | A62B 35/0093 |
| 2018/0289987 | A1 * | 10/2018 | Hung | A62B 1/14 |
| 2018/0333598 | A1 * | 11/2018 | Hung | A62B 35/0075 |
| 2019/0030381 | A1 * | 1/2019 | Hung | A62B 35/04 |

FOREIGN PATENT DOCUMENTS

| | | | |
|---|---|---|---|
| TW | M404024 U | * | 5/2011 |
| TW | M450390 U | * | 4/2013 |
| TW | M529524 U | * | 10/2016 |
| TW | M555231 U | * | 2/2018 |

* cited by examiner

*Primary Examiner* — Pamela Rodriguez
(74) *Attorney, Agent, or Firm* — R. Lynette Wylie; Apex Juris, pllc.

(57) ABSTRACT

A fall arrest device includes a bracket having first and second side panels, a rotating member rotatably mounted to the bracket, a safety belt wound around the rotating member, a brake wheel engaged with the rotating member and having a groove, a brake block pivotally connected to the brake wheel and located between an inner surface of the brake wheel and an outer surface of the first side panel, and a restoring spring. A stopper is disposed on the outer surface of the first side panel. In this way, the groove could accommodate a part of a body of the restoring spring, preventing the brake block from propelling away from a surface of the brake wheel by the restoring spring, preventing the brake block from rubbing against the first side panel.

10 Claims, 11 Drawing Sheets

FALL ARREST DEVICE

BACKGROUND OF THE INVENTION

Field of the Invention

The present invention relates to fall protection technology, and more particularly to a fall arrest device that is practical for use in a hanging work site.

Description of the Related Art

When working at height, people will be equipped with a fall arrest device containing a safety belt. The fall arrest device is fixed to a support, and the safety belt is attached to the person to prevent the person from falling, thus ensuring personnel safety.

FIG. 1 illustrates a conventional fall arrest device 1, which comprises a housing 10, and a bracket 12 a rotating member 14, a safety belt 16, a winding device 18, a brake wheel 20, and two brake blocks 22 respectively mounted in the housing 10. The housing 10 is made up of two shells 102. The bracket 12 has a first side panel 122 and a second side panel 124 facing each other. The rotating member 14 is rotatably mounted between the first side panel 122 and the second side panel 124. The first side panel 122 is provided with a stopper 122*a*. The safety belt 16 is wound around the rotating member 14. The reeling device 18 is disposed on an outer surface of the second side panel 124 and has a spiral spring 182 connected to the rotating member 14 for providing a force to rewind the safety belt 16. The brake wheel 20 is disposed on an outer surface of the first side panel 122 and is joined to and is rotated with the rotating member 14. The brake wheel 20 has an outer surface 202 facing away from the first side panel 122. The brake block 22 is pivotally mounted to a pivot axle 202*a* disposed on the outer surface 202 of the brake wheel 20. Further, the brake block 22 is disposed between the housing 10 and the first side panel 122. The brake block 22 is forced by the centrifugal force generated by the rotation of the brake wheel 20 to pivot from a restoring position to an extended position and to abut against the stopper 122*a* to restrict the rotation of the rotating member 14.

Referring to FIG. 3, if the user accidentally falls, the brake block 22 is normally forced to pivot from the restoring position to the extended position where the brake block 22 abuts against the stopper 122*a* to stop the rotating member 14 from rotating and to prevent the user from falling continuously.

However, the place where the fall arrest device 1 is used is usually in a dusty state, and the dust easily adheres to a pivotal joint of the brake block 22, causing the brake block 22 to get stuck. If the brake block 22 gets stuck, it cannot be pulled out in an emergency, causing the function of the emergency lock to be invalid. In order to prevent this problem, the pivot joint between the brake block 22 and the brake wheel 20 is loosely fitted to prevent the brake block 22 from being stuck due to a little dust.

However, the aforesaid loose fit design will give the brake block 22 a chance to bias in a direction away from the outer side 202 of the brake wheel 20 (as shown in FIG. 2). At this time, due to assembly tolerances and other factors, the spacing between the housing 10 and the outer surface 202 of the brake wheel 20 will be excessively large, and the stop portion 222 of the brake block 22 will be staggered with the stopper 122*a*, causing the emergency locking effect to be invalid.

SUMMARY OF THE INVENTION

The present invention has been accomplished under the circumstances in view. It is the main object of the present invention to provide a fall arrest device, which could effectively increase the reliability of emergency locking performance.

To achieve this and other objects of the present invention, a fall arrest device comprises a bracket, a rotating member, a safety belt, a brake wheel, a brake block, and a restoring spring. The bracket has a first side panel and a second side panel facing each other, wherein a stopper is disposed on the first side panel. The rotating member is rotatably mounted between the first side panel and second side panel of the bracket. The safety belt is wound around the rotating member and is located between the first side panel and the second side panel, wherein the safety belt is pulled to drive the rotating member to rotate. The brake wheel is engaged with the rotating member. The brake block is pivotally mounted to the brake wheel and has a stop portion. The stop portion of the brake block is forced by a centrifugal force generated during a rotation of the brake wheel to pivot from a restoring position to an extended position where the brake block abuts against the stopper to restrict a rotation of the rotating member. The restoring spring is connected between the brake block and the brake wheel, and is adapted to urge the brake block to move toward the restoring position.

By using the first side panel and the brake wheel to limit the position of the brake block, the brake block could be abutted against the stopper when the brake block is in the extended position, eliminating the problem that due to pivoting of the brake block, the brake block of the conventional fall arrest device is staggered with the stopper in the extended position, and therefore, the invention effectively increases the reliability of emergency locking performance of the fall arrest device.

BRIEF DESCRIPTION OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
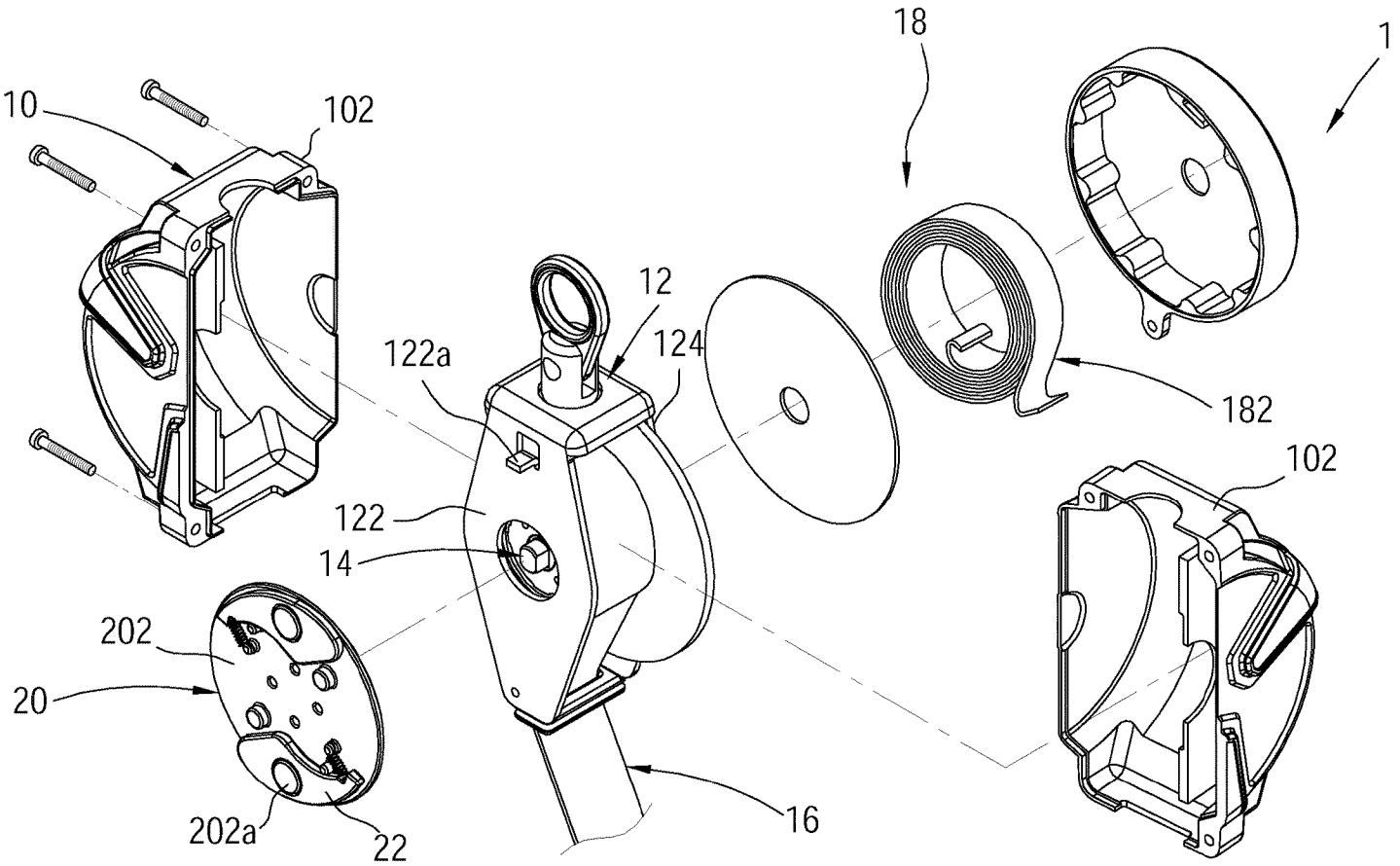
FIG. 1 (PRIOR ART)
FIG. 1 is an exploded view of a conventional fall arrest device.
Figure 3:
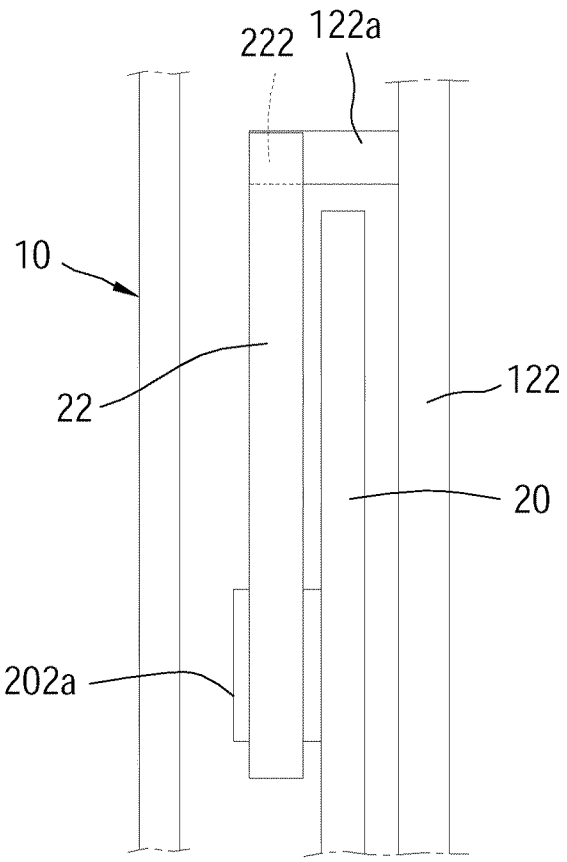
FIG. 3 (PRIOR ART)
FIG. 3 is a schematic view, illustrating the stop portion of the brake block abuts against the stopper.
Figure 2:
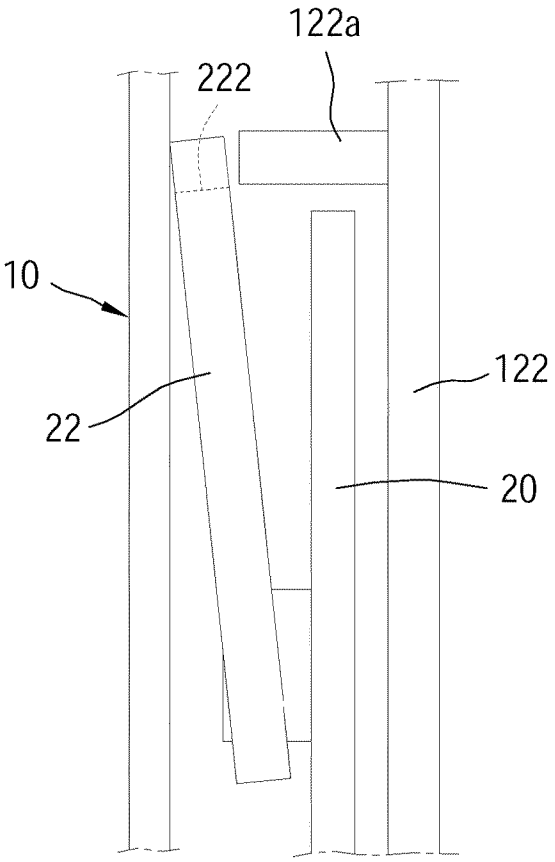
FIG. 2 (PRIOR ART)
FIG. 2 is a schematic view, illustrating the stop portion of the brake block is out of the normal position and cannot be abutted against the stopper.
Figure 4:
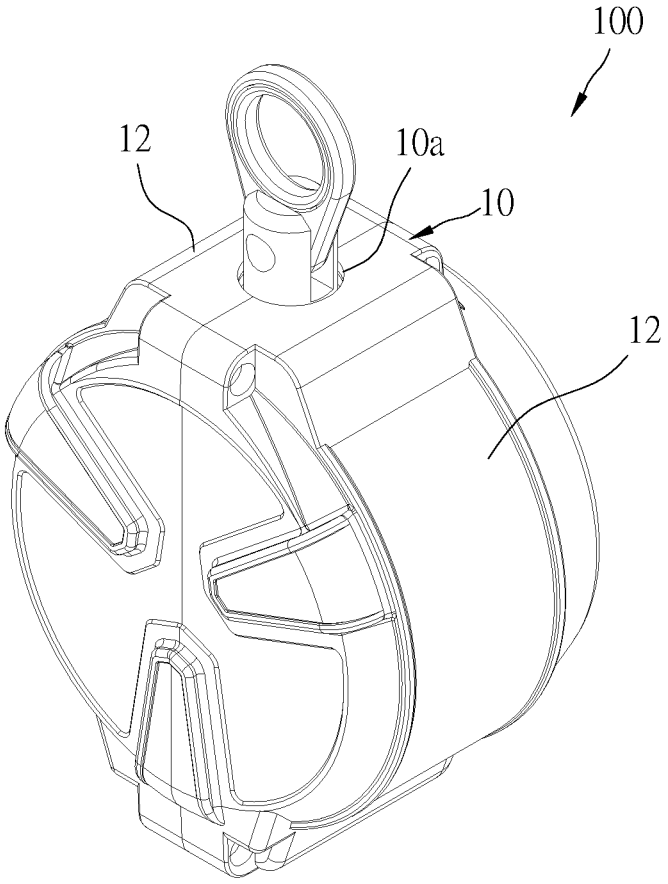
FIG. 4 is a perspective view of the fall arrest device in accordance with an embodiment of the present invention.
Figure 5:
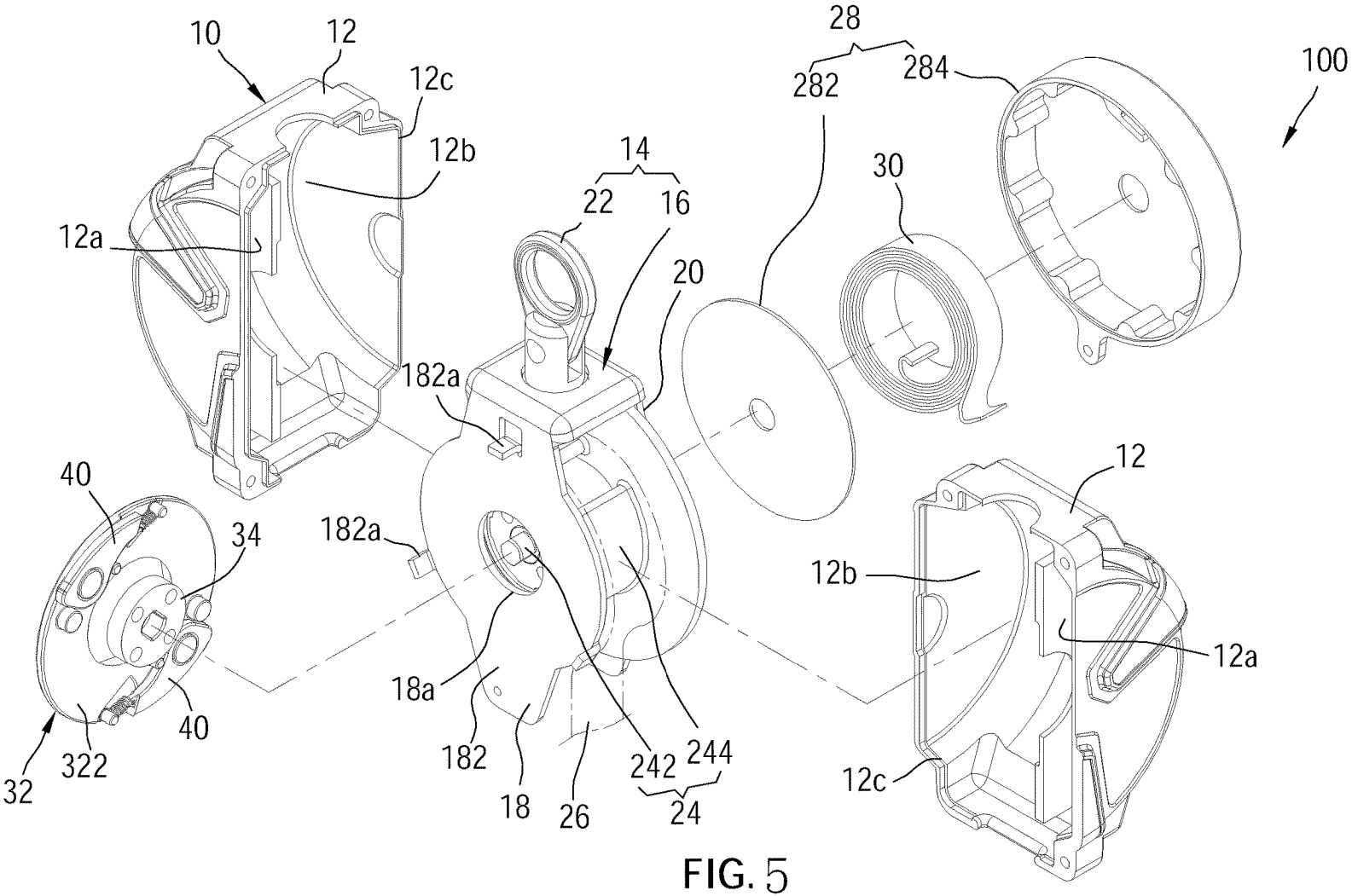
FIG. 5 is an exploded view of the fall arrest device in accordance with the embodiment of the present invention.
Figure 6:
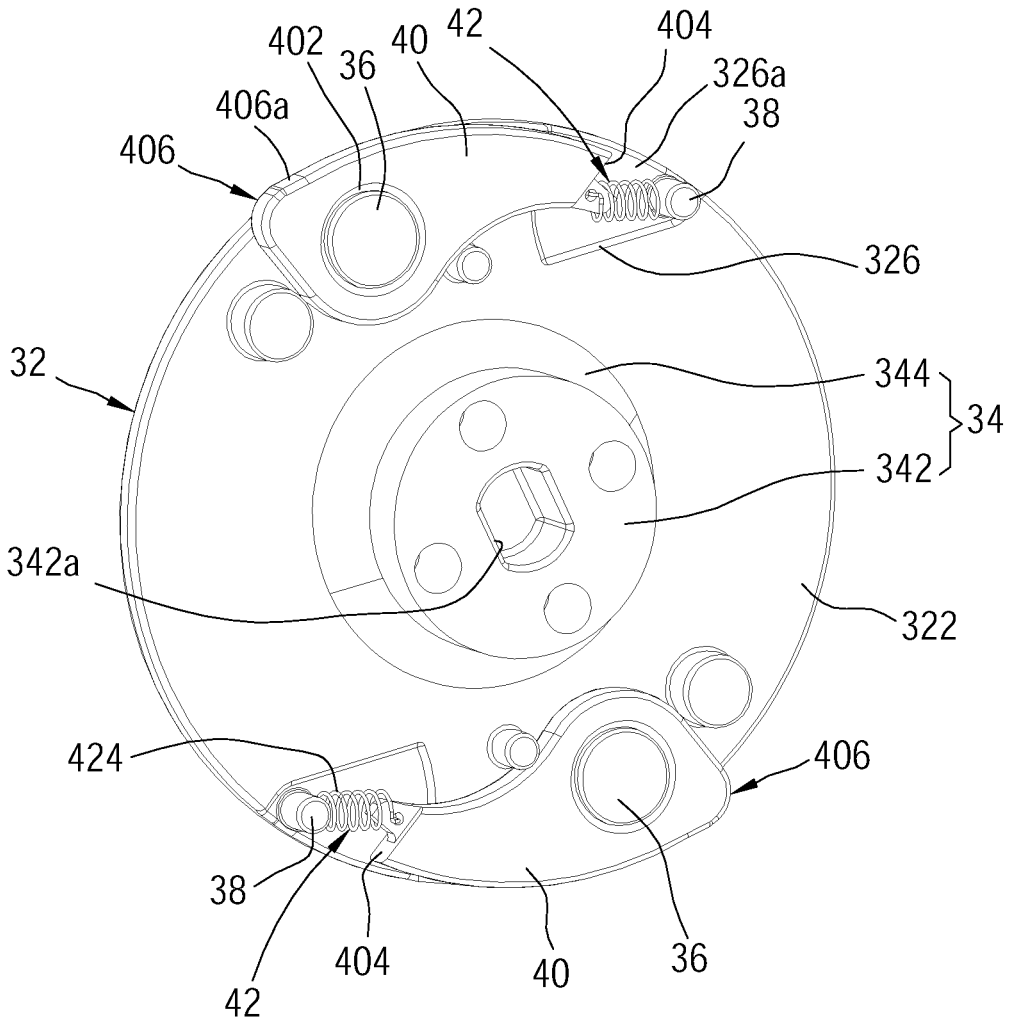
FIG. 6 is a perspective view of the brake wheel and the brake block of the fall arrest device in accordance with the embodiment of the present invention.

Referring to FIG. 4 to FIG. 9, a fall arrest device 100 in accordance with an embodiment of the present invention is shown. As illustrated, the fall arrest device 100 comprises a housing 10, and a bracket 14, a rotating member 24, a safety belt 26, a box 28, a spiral spring 30, a brake wheel 32, at least one brake block 40, and at least one restoring spring 42 which are disposed in the housing 10.

Two shells 12 match with each other to form the housing 10, wherein each of the two shells 12 has a first chamber 12*a*, a second chamber 12*b*, and an opening 12*c*. Two shells 12 are connected to each other via the two openings 12*c*. Further, the housing 10 has a top hole 10*a* and a bottom hole (not shown).

The bracket 14 comprises a frame body 16 and a hanging ring 22 which is engaged with a top of the frame body 16. The frame body 16 has a first side panel 18 and a second side panel 20 facing each other. The first side panel 18 is located in the first chambers 12*a* of the two shells 12. The second side panel 20 is located in the second chambers 12*b* of the two shells 12. The first side panel 18 has a perforation 18*a* and an outer surface 182 facing away from the second side panel 20, wherein at least one stopper 182*a* is disposed on the outer surface 182. In this embodiment, three stoppers 182*a* are disposed on the outer surface 182. The hanging ring 22 protrudes from the top hole 10*a* of the housing 10.

The rotating member 24 is rotatably disposed between the first side panel 18 and second side panel 20 of the frame body 16, comprising a shaft 242 and a rotating drum 244. The shaft 242 has two opposite ends thereof respectively passing through the perforation 18*a* of the first side panel 18 of the bracket 14 and the second side panel 20. The rotating drum 244 is disposed on the shaft 242 and rotates coaxially with the shaft 242. A portion of the rotating drum 244 is exposed inside the perforation 18*a*.

The safety belt 26 is wound around the rotating member 24 between the first side panel 18 and second side panel 20. More specifically, an end of the safety belt 26 is connected to and is wound around the rotating drum 244, while another end thereof extends out of the housing 10 through the bottom hole of the housing 10. The safety belt 26 could be pulled to rotate the rotating drum 244 and the shaft 242.

The box 28 is located in the second chambers 12*b* of the two shells 12 and is connected to the second side panel 20 of the bracket 14. The box 28 consists of a first portion 282 and a second portion 284. The spiral spring 30 is disposed between the first portion 282 and the second portion 284, and an inner end of the spiral spring 30 is connected to the rotating member 24, and an outer end thereof is connected to the box 28.

The brake wheel 32 is engaged with the rotating member 24 and coaxially rotates with the rotating member 24 and has an inner surface 322 facing the outer surface 182 of the first side panel 18. In this embodiment, the brake wheel 32 is circular in shape. A central portion of the inner surface 322 protrudes to form a protruding shaft 34, wherein the protruding shaft 34 comprises a first segment 342 and a second segment 344 connected to each other. The first segment 342 has a constant diameter and passes through the perforation 18*a* of the first side panel 18 to be engaged with the rotating drum 244 of the rotating member 24. Further, the first segment 342 has a shaft hole 342*a* for being penetrated by the shaft 242. The second segment 344 has a tapered shape, and an outer diameter of the second segment 344 is gradually increased from the first segment 342 to the inner surface 322. With such design, a strength of the brake wheel 32 could be increased and an interference with the first side panel 18 during the rotation of the brake wheel 32 is minimized. The brake wheel 32 further comprises at least one pivot axle 36 and at least one fixing rod 38 respectively located at the inner surface 322. In this embodiment, two pivot axles 36 and two fixing rods 38 are provided. The two pivot axles 36 and the two fixing rods 38 are respectively located on two opposite sides relative to the protruding shaft 34.

The inner surface 322 of the brake wheel 32 has a surface 324, wherein the surface 324 is recessed to form at least one groove 326. In this embodiment, two grooves 326 are formed in the inner surface 322 of the wheel body 32. Each fixing rod 38 has an end thereof connected to a surface 326*a* of one respective groove 326. Further, each fixing rod 38 protrudes beyond the corresponding groove 326.

Figure 10:
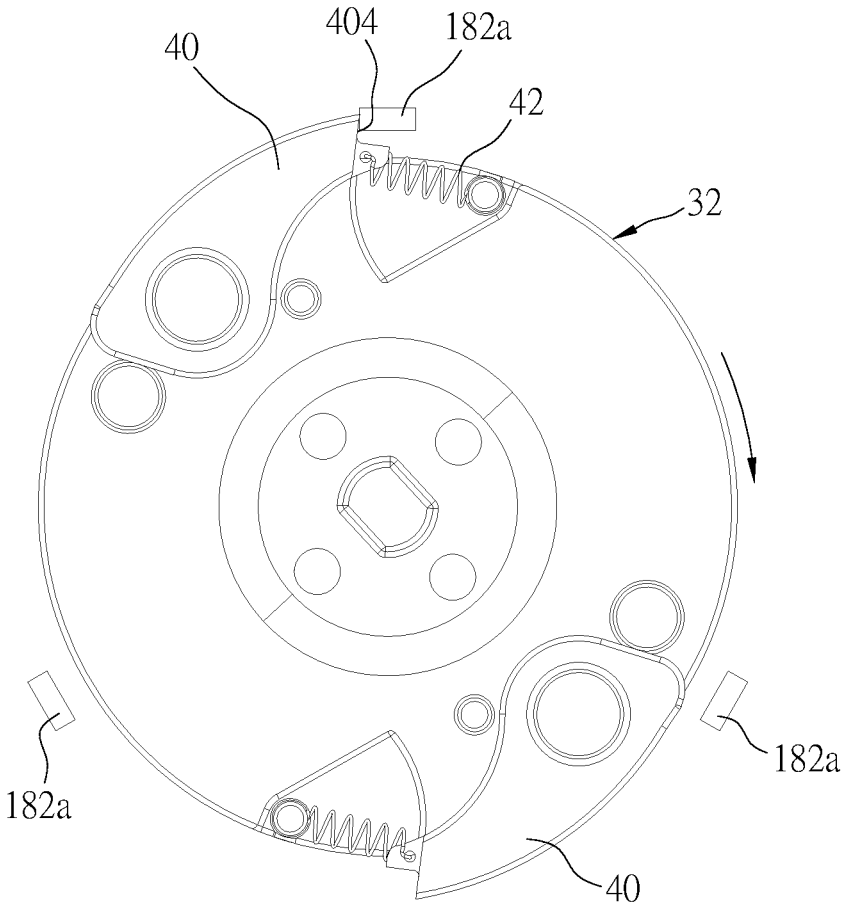
FIG. 10 is a schematic view, illustrating the brake block is located in the extended position and abuts against the stopper.

In the current embodiment, the fall arrest device 100 includes two brake blocks 40, wherein each brake block 40 has a pivot hole 402. An outer diameter of each of the pivot holes 402 is greater than an outer diameter of the pivot axle 36 at the brake wheel 32. The brake block 40 is pivotally connected to the pivot axle 36 at the inner surface 322 of the brake wheel 32 via the pivot hole 402, such that the brake block 40 is located in the space between the inner surface 322 of the brake wheel 32 and the outer surface 182 of the first side panel 18. The pivot hole 402 of the brake block 40 and the pivot axle 36 are loosely fitted to avoid dust entering between the pivot axle 36 and the pivot hole 402. The brake block 40 could be pivoted between an extended position (see FIG. 10) and a restoring position (see FIG. 11). Each brake block 40 has a stop portion 404. The stop portion 404 of the brake block 40 is spun out to the extended position with the centrifugal force generated by the rotation of the brake wheel 32 to abut against the stopper 182*a*, thereby limiting the rotation of the rotating member 24.

Figure 7:
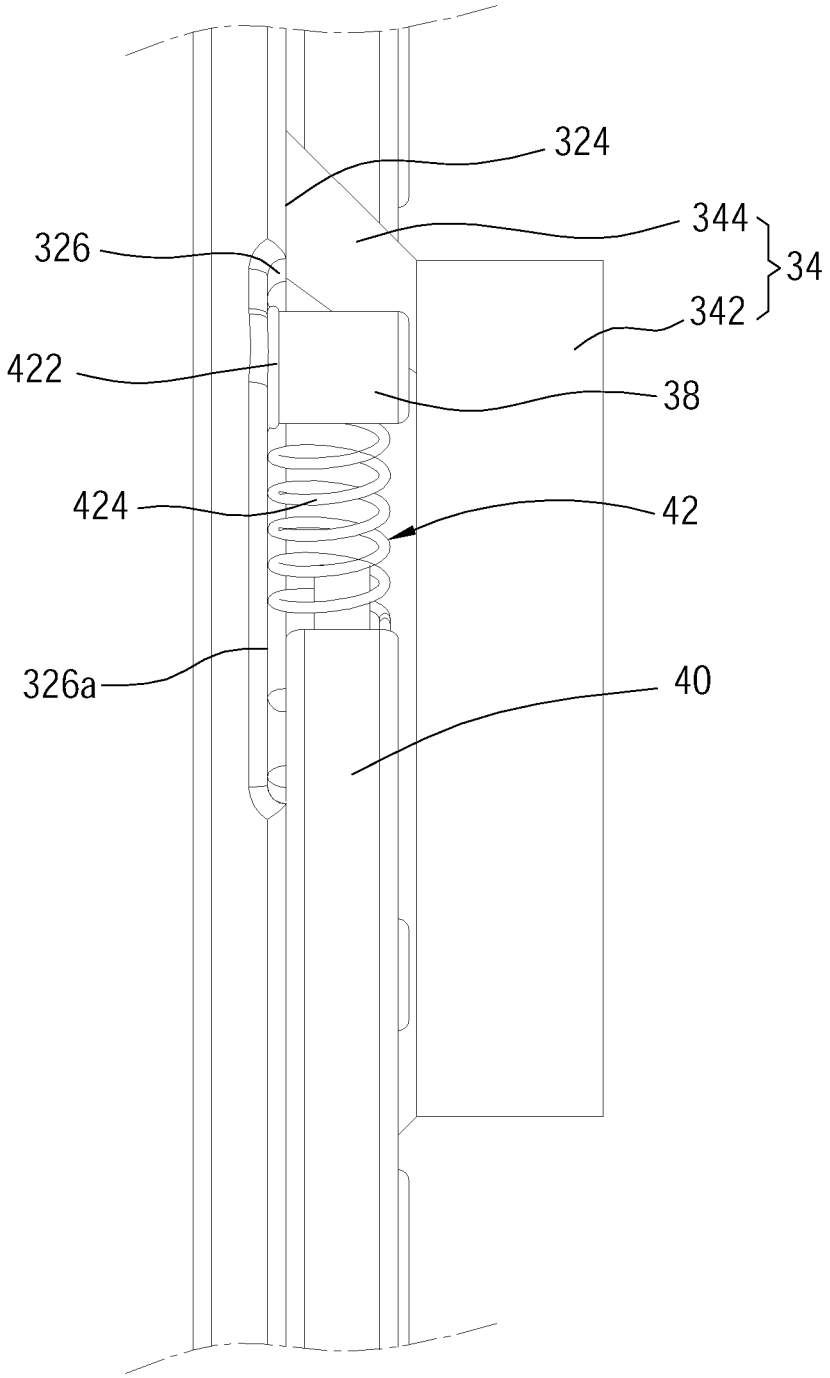
FIG. 7 is a sectional side view of FIG. 6.
Figure 8:
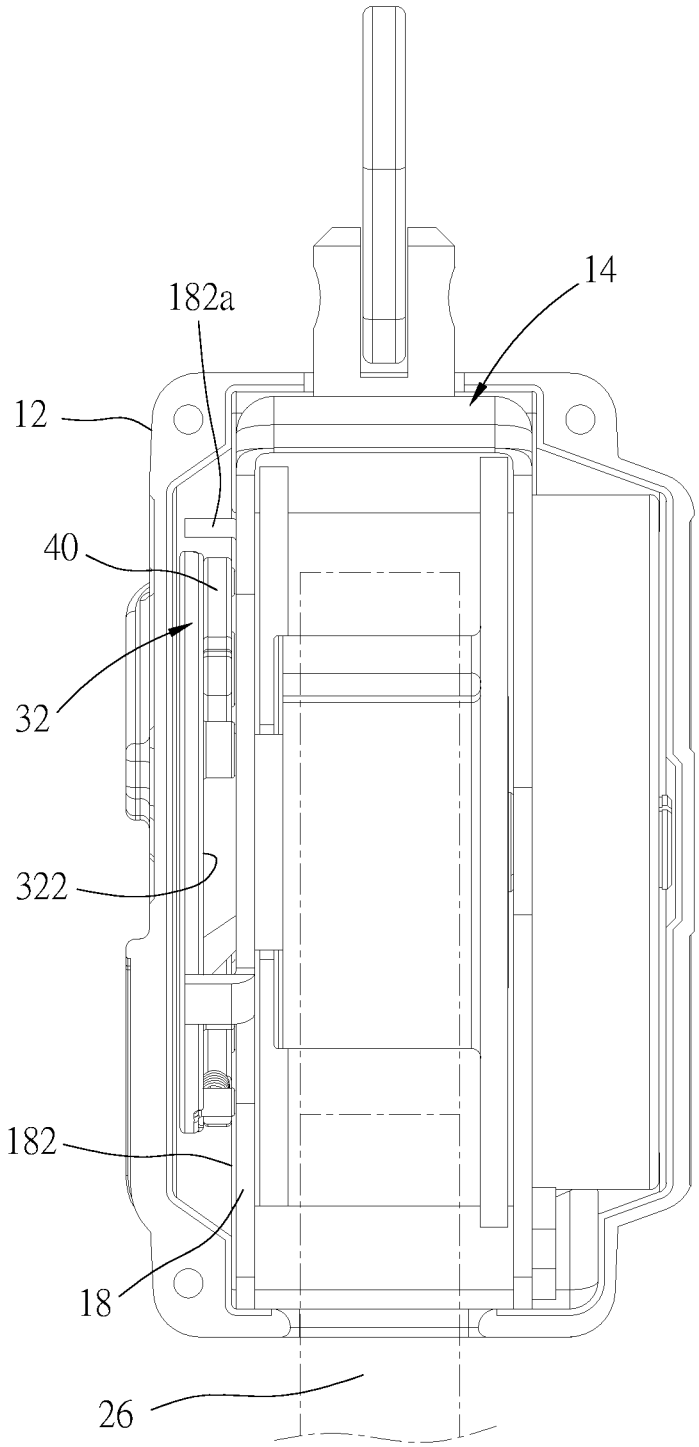
FIG. 8 is a side view of the fall arrest device in accordance with the embodiment of the present invention which omits one of the shells.
Figure 9:
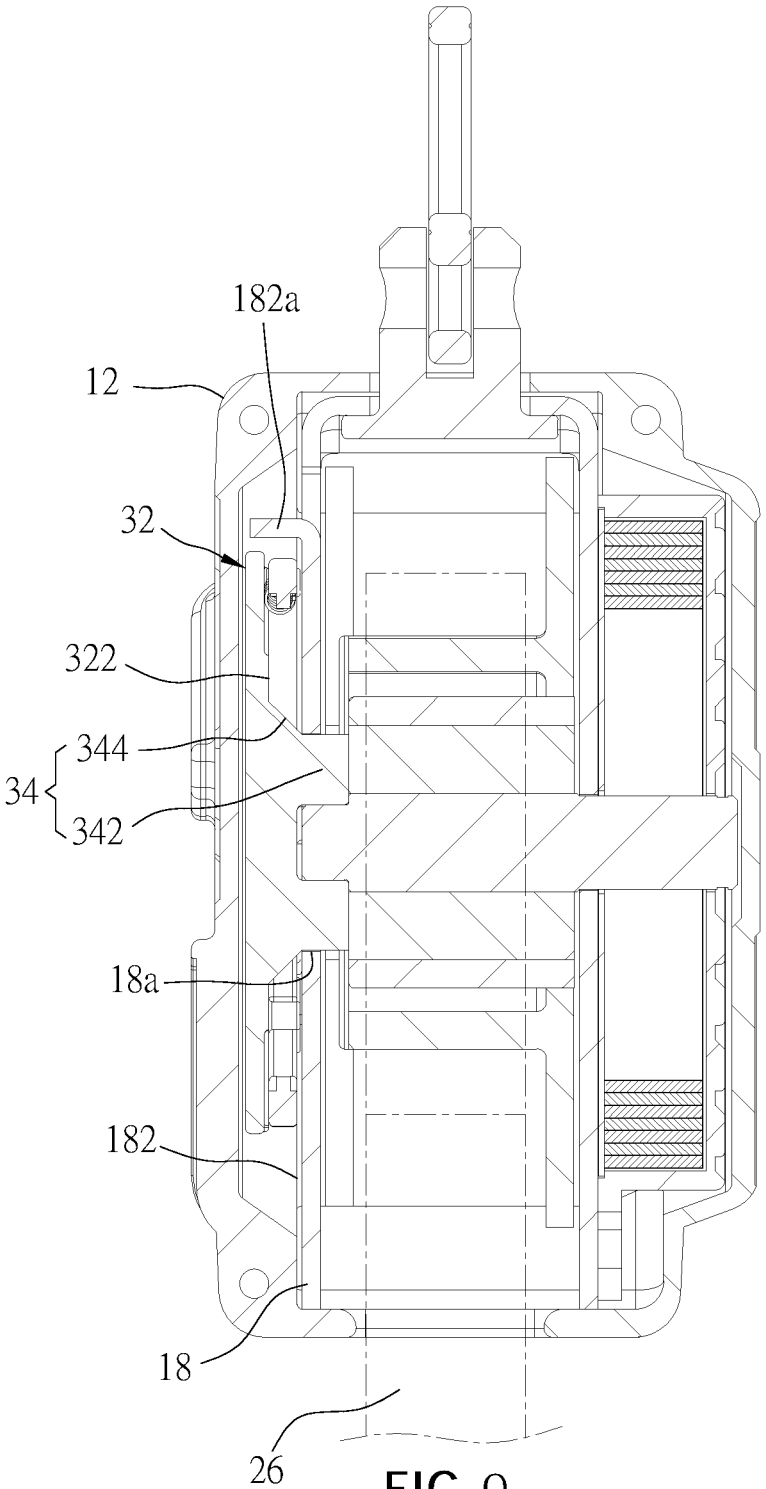
FIG. 9 is a sectional view of FIG. 8.

The at least one restoring spring 42 is connected between the at least one brake block 40 and the brake wheel 322 to urge the at least one brake block 40 to remain in the restoring position, so that the stop portion 404 of each brake block 40 is normally located in an area of an outer periphery of the brake wheel 32. In this embodiment, two restoring springs 42 are provided. Each restoring spring 42 has an end thereof connected to one respective brake block 40 and is located adjacent to the stop portion 404, and another end thereof terminates in a ring 422 fitting around the corresponding fixing rod 38. Further, the ring 422 is located between the surface 324 on the brake wheel 32 and the surface 326*a* of the respective groove 326 (as shown in FIG. 7), so that the restoring spring 42 is close to the surface 324 of the brake wheel 32, and each brake block 40 is close to the surface 324 of the brake wheel 32. Each restoring spring 42 has a body 424 for generating an elastic force, wherein the groove 326 accommodates a part of the body 424 of the restoring spring 42. When the brake block 40 is in the restoring position, each of the restoring springs 42 is located in an orthographic projection area of the corresponding groove 326. The design of the groove 326 could accommodate a part of the body 424 to prevent the brake block 40 from propping away from the surface 324 by the restoring spring 42, preventing the brake block 40 from rubbing against the first side panel 18.

When the user accidentally falls, the safety belt 26 will be pulled sharply to rotate the rotating member 24 and the brake wheel 32 rapidly, so that each brake block 40 is subjected to a centrifugal force and overcomes the elastic force of the respective restoring spring 42 to be spun out. At this time, one of the brake blocks 40 abuts against one of the stoppers 182*a* to restrict the rotation of the rotating member 24 and to fix the pulled out length of the safety belt 26, preventing the user from falling continuously.

It is worth mentioning that by using the first side panel 18 and the brake wheel 32 to limit the position of the brake block 40, the stop portion 404 could be ensured to abut against the stopper 182*a* when the brake block 40 is in the extended position, eliminating the problem that due to pivoting of the brake block, the brake block of a conventional fall arrest device is staggered with the stopper in the extended position.

In order to avoid the problem that the brake blocks 40 cannot be pivoted due to accumulated dust in a pivotal joint between each brake block 40 and the brake wheel 32, the structure of the brake blocks 40 of the present invention is specially designed. Take one of the brake blocks 40 as an example for explanation of the design as follows.

Figure 11:
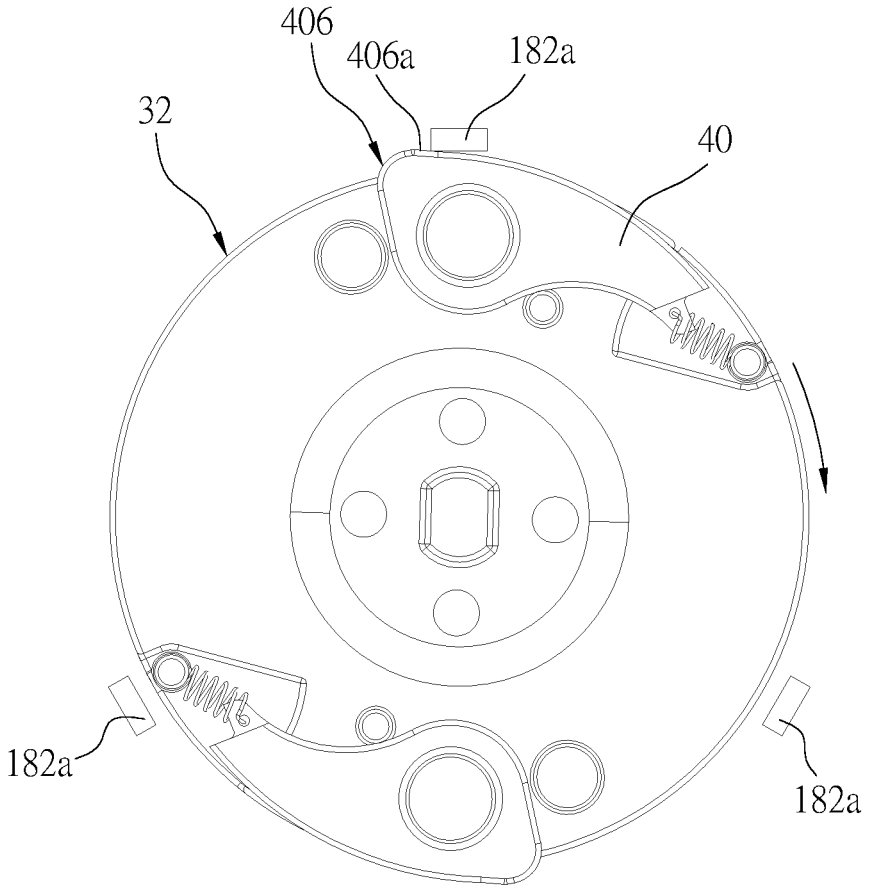
FIG. 11 is a schematic view, illustrating the brake block is located in the restoring position and passes through the stopper.
Figure 12:
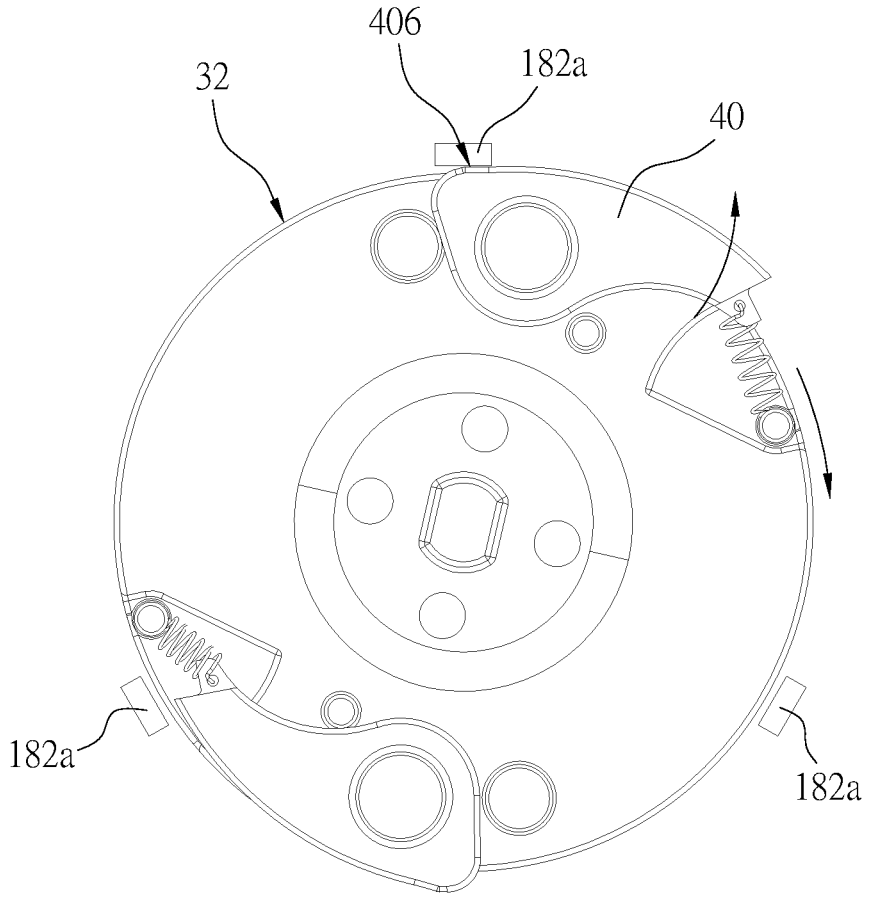
FIG. 12 is a schematic view, illustrating the bearing portion of the brake block is pushed by the stopper to bias outward.

The brake block 40 further has a bearing portion 406. The bearing portion 406 and the stop portion 404 are respectively disposed at two opposite sides relative to the pivot hole 402. The bearing portion 406 moves along a moving path as the brake wheel 32 rotates, and the stopper 182*a* is located in the moving path of the bearing portion 406. In this embodiment, an outer edge 406*a* of the bearing portion 406 protrudes away from the pivot hole 402 to be beyond the outer periphery of the brake wheel 32. Whenever the bearing portion 406 passes through the stopper 182*a*, the bearing portion 406 is pushed by the stopper 182*a*, so that the brake block 40 pivots outward (as shown in FIG. 12) from the restoring position (as shown in FIG. 11).

Therefore, the user could pull the safety belt 26 in advance to know that the brake block 40 is not stuck via a vibration generated by the pivoting of the brake block 40, confirming that the fall arrest device 100 could operate normally. It is worth mentioning that, in a case that the brake block 40 is stuck and cannot be pivoted, the bearing portion 406 of the brake block 40 could abut against the stopper 182*a* to restrict the rotation of the rotating member 24, preventing the user from falling continuously, so that the fall arrest device 100 could provide a double protection effect.

It must be pointed out that the embodiments described above are only some preferred embodiments of the present invention. All equivalent structures which employ the concepts disclosed in this specification and the appended claims should fall within the scope of the present invention.

What is claimed is:

1. A fall arrest device, comprising:

a bracket which has a first side panel and second side panel facing each other, wherein a stopper is disposed on said first side panel;

a rotating member rotatably mounted between said first side panel and said second side panel of said bracket;

a safety belt which is wound around said rotating member and is located between said first side panel and said second side panel, wherein the safety belt is pulled to drive said rotating member to rotate;

a brake wheel engaged with said rotating member;

a brake block pivotally mounted to said brake wheel, wherein said brake block has a stop portion; said stop portion of said brake block is forced by a centrifugal force generated during a rotation of said brake wheel to pivot from a restoring position to an extended position where said brake block abuts against said stopper to restrict a rotation of said rotating member; and a restoring spring which is connected between said brake block and said brake wheel, and is adapted to urge said brake block to move toward said restoring position;

wherein said brake wheel has a surface, and said surface is recessed to form a groove; when said brake block is in said restoring position, said restoring spring is located in an orthographic projection area of said groove.

2. The fall arrest device as claimed in claim 1, wherein said brake wheel comprises a fixing rod; an end of said fixing rod is engaged with a surface of said groove; an end of said restoring spring is connected to said brake block and is located adjacent to said stop portion, and another end of said restoring spring terminates in a ring fitting around said fixing rod.

3. The fall arrest device as claimed in claim 2, wherein said ring of said restoring spring is disposed between said surface of said brake wheel and said surface of said groove.

4. The fall arrest device as claimed in claim 1, wherein said restoring spring has a body partially protruding into said groove.

5. The fall arrest device as claimed in claim 1, wherein an end of said restoring spring is connected to said brake block adjacent to said stop portion.

6. The fall arrest device as claimed in claim 1, wherein said first side panel has an outer surface facing away from said second side panel; said stopper is disposed on said outer surface of said first side panel; said brake wheel has an inner surface facing said outer surface of said first side panel, and said inner surface has said surface of said brake wheel.

7. The fall arrest device as claimed in claim 6, wherein a pivot axle is disposed on said inner surface of said brake wheel; said brake block has a pivot hole and a bearing portion, wherein said pivot hole fits around said pivot axle; said bearing portion and said stop portion are respectively disposed on two opposite sides relative to said pivot hole; said bearing portion moves along a moving path as said brake wheel rotates; said stopper is located in said moving path of said bearing portion; when said bearing portion passes through said stopper, said bearing portion is pushed by said stopper to pivot said brake block.

8. The fall arrest device as claimed in claim 7, wherein said brake wheel has an outer periphery; an outer edge of said bearing portion protrudes away from said pivot hole and beyond said outer periphery of said brake wheel; when said bearing portion passes through said stopper, said outer edge of said bearing portion passes therethrough and abuts against said stopper.

9. The fall arrest device as claimed in claim 6, wherein said first side panel of said bracket has a perforation; a protruding shaft is disposed on said inner surface of said brake wheel; said protruding shaft comprises a first segment and a second segment connected to each other; said first segment passes through said perforation of said first side panel and is engaged with said rotating member; an outer diameter of said second segment is gradually increased from the first segment toward said inner surface.

10. The fall arrest device as claimed in claim 1, wherein when said brake block is located in said extended position, said restoring spring is located in the orthographic projection area of said groove.

* * * * *